US011452188B2

(12) United States Patent
Chen et al.

(10) Patent No.: US 11,452,188 B2
(45) Date of Patent: Sep. 20, 2022

(54) CURRENT DRIVE CIRCUIT AND METHOD, AND LIGHT EMITTING DIODE LIGHTING DEVICE THEREOF

(71) Applicant: Silergy Semiconductor Technology (Hangzhou) LTD, Hangzhou (CN)

(72) Inventors: Hao Chen, Hangzhou (CN); Jianxin Wang, Hangzhou (CN); Huiqiang Chen, Hangzhou (CN); Zhishuo Wang, Hangzhou (CN)

(73) Assignee: Silergy Semiconductor Technology (Hangzhou) LTD, Hangzhou (CN)

( * ) Notice: Subject to any disclaimer, the term of this patent is extended or adjusted under 35 U.S.C. 154(b) by 350 days.

(21) Appl. No.: 16/851,409

(22) Filed: Apr. 17, 2020

(65) Prior Publication Data

US 2020/0344857 A1 Oct. 29, 2020

(30) Foreign Application Priority Data

Apr. 24, 2019 (CN) ..... 201910335411.9
Mar. 4, 2020 (CN) ..... 202010142587.5

(51) Int. Cl.

| | |
|---|---|
| ***H05B 45/30*** | (2020.01) |
| ***H05B 45/325*** | (2020.01) |
| ***H05B 45/48*** | (2020.01) |
| ***H05B 44/00*** | (2022.01) |

(52) U.S. Cl.
CPC ..... *H05B 45/325* (2020.01); *H05B 44/00* (2022.01); *H05B 45/48* (2020.01)

(58) Field of Classification Search
CPC combination set(s) only.
See application file for complete search history.

(56) References Cited

U.S. PATENT DOCUMENTS

| | | | | |
|---|---|---|---|---|
| 5,528,481 | A | 6/1996 | Caldeira et al. | |
| 8,310,846 | B2 | 11/2012 | Piazzesi | |
| 8,917,068 | B2 | 12/2014 | Chen et al. | |
| 9,331,588 | B2 | 5/2016 | Chen | |
| 9,762,113 | B2 | 9/2017 | Chen et al. | |
| 2015/0078041 | A1 | 3/2015 | Huang | |
| 2015/0311810 | A1 | 10/2015 | Chen et al. | |
| 2016/0088697 | A1* | 3/2016 | Yan | H05B 45/10 315/307 |
| 2017/0047853 | A1 | 2/2017 | Chen et al. | |
| 2018/0310376 | A1* | 10/2018 | Huang | H05B 45/10 |

* cited by examiner

*Primary Examiner* — Long Nguyen

(57) ABSTRACT

A current drive circuit applied in an LED drive circuit that is compatible with a triac dimmer and is configured to generate a direct current bus voltage includes: a current generation circuit configured to receive the direct current bus voltage, and to generate a drive current based on a PWM dimming signal, in order to drive an LED load; and an input current regulation circuit configured to generate a regulation signal based on a duty cycle of the PWM dimming signal, in order to control an operation state of the triac dimmer.

20 Claims, 12 Drawing Sheets

CURRENT DRIVE CIRCUIT AND METHOD, AND LIGHT EMITTING DIODE LIGHTING DEVICE THEREOF

RELATED APPLICATIONS

This application claims the benefit of Chinese Patent Application No. 201910335411.9, filed on Apr. 24, 2019, and of Chinese Patent Application No. 202010142587.5, filed on Mar. 4, 2020, both of which are incorporated herein by reference in their entirety.

FIELD OF THE INVENTION

The present invention generally relates to the field of power electronics, and more particularly to current drive circuits and methods compatible with a triac dimmer, and associated light-emitting diode (LED) lighting devices.

BACKGROUND

A switched-mode power supply (SMPS), or a "switching" power supply, can include a power stage circuit and a control circuit. When there is an input voltage, the control circuit can consider internal parameters and external load changes, and may regulate the on/off times of the switch system in the power stage circuit. Switching power supplies have a wide variety of applications in modern electronics. For example, switching power supplies can be used to drive light-emitting diode (LED) loads.

DETAILED DESCRIPTION

Reference may now be made in detail to particular embodiments of the invention, examples of which are illustrated in the accompanying drawings. While the invention may be described in conjunction with the preferred embodiments, it may be understood that they are not intended to limit the invention to these embodiments. On the contrary, the invention is intended to cover alternatives, modifications and equivalents that may be included within the spirit and scope of the invention as defined by the appended claims. Furthermore, in the following detailed description of the present invention, numerous specific details are set forth in order to provide a thorough understanding of the present invention. However, it may be readily apparent to one skilled in the art that the present invention may be practiced without these specific details. In other instances, well-known methods, procedures, processes, components, structures, and circuits have not been described in detail so as not to unnecessarily obscure aspects of the present invention.

A triac dimmer may perform dimming with a phase control method. That is, the triac dimmer can be controlled to be turned on based on per half cycle of a sinusoidal signal, in order to obtain the same turned-on phase angle. The turned-on phase angle may be changed by regulating a chopped phase of the triac dimmer, in order to perform dimming. The triac dimmer can be used to perform dimming on incandescent bulbs. With the popularization of light-emitting diode (LED) light sources, triac dimmers are increasingly used by LED drive circuits to perform dimming. Demand exists for an LED drive circuit to not only compatible with a triac (e.g., compatible with only a maximum turned-on angle of the triac), but also to be capable of analog dimming with an analog dimming depth reaching about 1%. Since triac dimmers are widely used in the market, an LED drive circuit may be compatible with traditional triac dimmers, while also being compatible with an intelligent dimming scheme.

Figure 1:
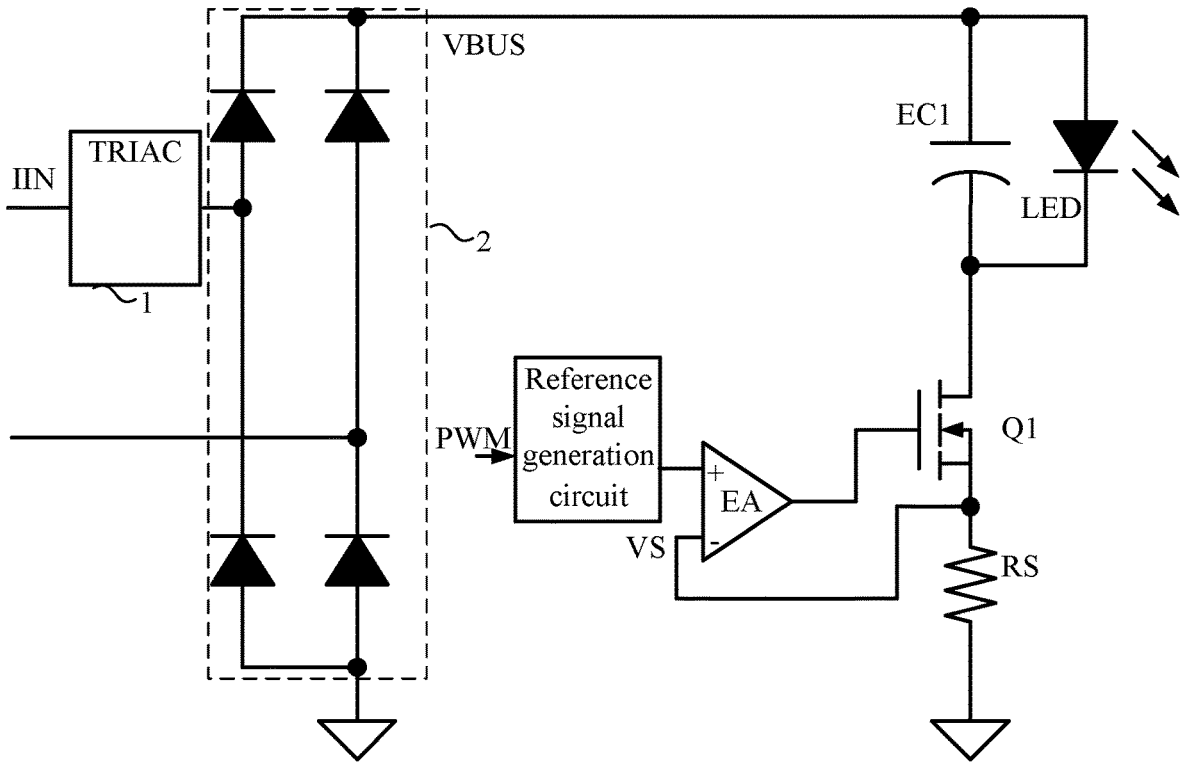
FIG. 1 is a schematic structural diagram of an example LED drive circuit.

Referring now to FIG. 1, shown is a schematic structural diagram of an example LED drive circuit. In this example LED drive circuit, a duty cycle of an external pulse-width modulation (PWM) dimming signal can be detected, in order to change an internal reference current by a reference signal generation circuit. A drive current may be sampled via resistor RS, and the sampled drive current can be compared against a reference current. Error amplifier EA can output a control signal for transistor Q1, in order to control transistor Q1 to generate a corresponding output current.

Figure 2:
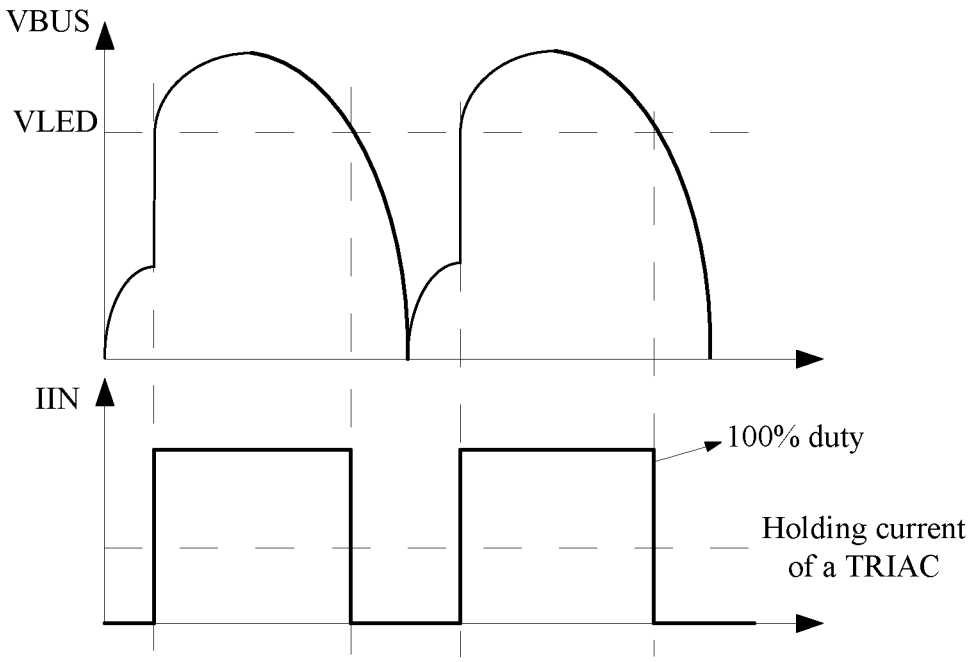
FIG. 2 is a waveform diagram of an example operation of the LED drive circuit of FIG. 1.

Referring now to FIG. 2, shown is a waveform diagram of an example operation of the LED drive circuit of FIG. 1. This example shows an operation waveform when the duty cycle of the PWM dimming signal is equal to 100%. In this case, since the reference current is large, input current IIN is also large and greater than a holding current of the triac dimmer when triac dimmer TRIAC is turned on, such that the system can operate normally.

Figure 3:
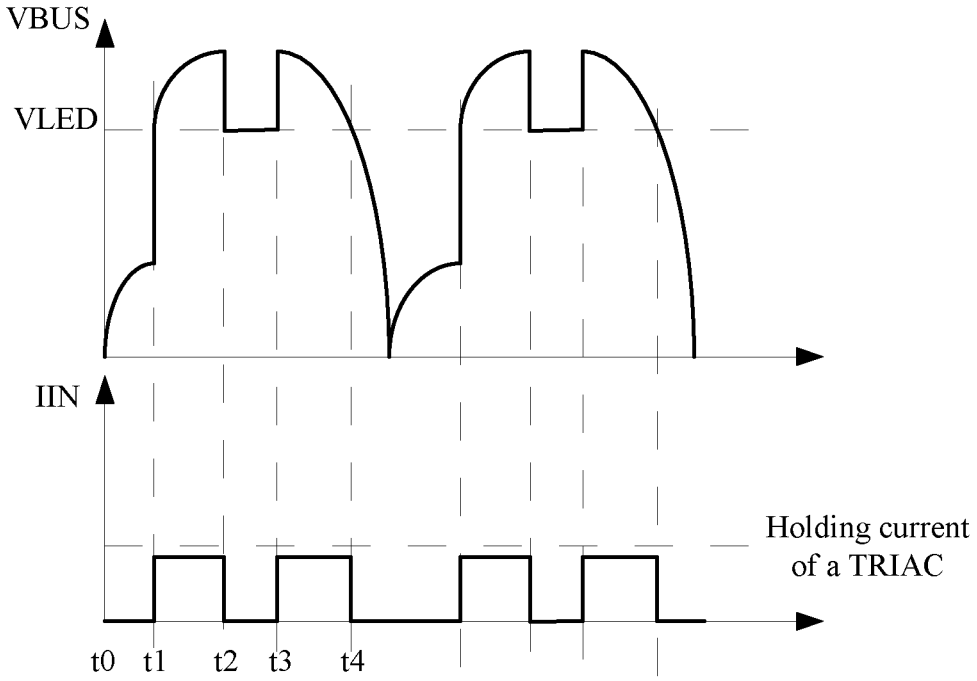
FIG. 3 is a waveform diagram of another example operation of the LED drive circuit of FIG. 1.

Referring now to FIG. 3, shown is a waveform diagram of another example operation of the LED drive circuit of FIG. 1. This example shows an operation waveform when the duty cycle of the PWM dimming signal is relatively small. In a time period of t0 to t1, the triac dimmer can operate at an integration phase and is not turned on yet. In a time period of t1 to t2, at time t1, the triac dimmer can complete integration and be turned on. In a time period of t2 to t3, at time t2, since the duty cycle of the PWM dimming signal is small, input current IIN may be less than the holding current of the triac dimmer, and thus the triac dimmer is turned off, and a direct current bus voltage VBUS may be clamped at LED voltage VLED. In a time period of t3 to t4, since the triac dimmer is restarted to be turned on at time t3 due to the internal integration of the triac dimmer in a previous time period, a flicker of an LED load can inevitably occur in a dimming process due to the restarting of the triac dimmer. Therefore, the LED drive circuit in this approach may not be compatible with triac dimmer TRIAC.

In one embodiment, a current drive circuit applied in an LED drive circuit that is compatible with a triac dimmer and is configured to generate a direct current bus voltage, can include: (i) a current generation circuit configured to receive the direct current bus voltage, and to generate a drive current based on a PWM dimming signal, in order to drive an LED load; and (ii) an input current regulation circuit configured to generate a regulation signal based on a duty cycle of the PWM dimming signal, in order to control an operation state of the triac dimmer.

Figure 4:
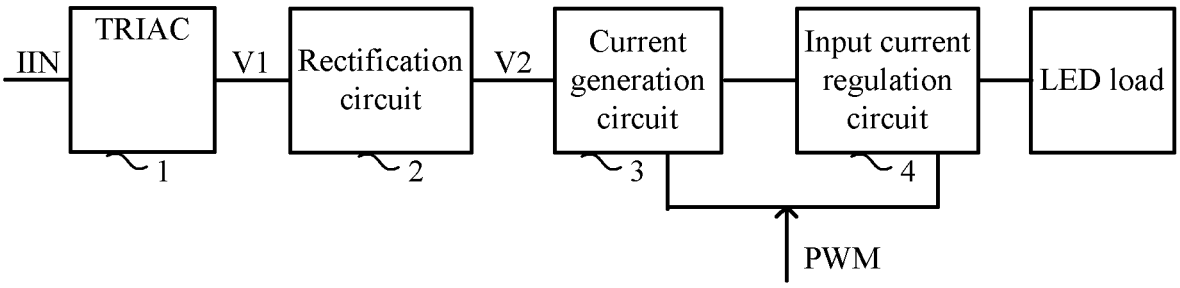
FIG. 4 is a schematic block diagram of a first example current drive circuit, in accordance with embodiments of the present invention.

Referring now to FIG. 4, shown is a schematic block diagram of a first example current drive circuit, in accordance with embodiments of the present invention. In this particular example, the LED lighting device can include triac dimmer (TRIAC) 1 and rectification circuit 2. A current drive circuit may be applied in the LED lighting device, and can include current generation circuit 3 and input current regulation circuit 4. Triac dimmer TRIAC can connect between an input port of an alternating current voltage and the rectification circuit 2. Triac dimmer TRIAC can perform phase-cutting on the alternating current voltage, in order to output voltage signal V1. Rectification circuit 2 can perform conversion on the alternating current voltage chopped by the triac dimmer TRIAC; that is, to rectify voltage signal V1, in order to output voltage signal V2 to a direct current bus. Current generation circuit 3 can receive voltage signal V2, and may generate drive current ILED based on the PWM dimming signal, in order to drive an LED load. Current generation circuit 3 may be implemented by a switch-type regulator to generate a constant drive current based on the PWM dimming signal.

Alternatively, current generation circuit 3 may be implemented by a constant current linear drive circuit, which may generate a constant drive current based on the PWM dimming signal. Input current regulation circuit 4 can generate regulation signal Vreg based on a duty cycle of the PWM dimming signal, in order to control an operation state of triac dimmer TRIAC based on regulation signal Vreg. In this way, when the duty cycle of the PWM dimming signal is small, the input current IIN can be reduced to be less than a holding current of triac dimmer TRIAC, such that triac dimmer TRIAC is turned-off. This can substantially avoid the problem of the LED load flickering due to a small duty cycle of the PWM dimming signal. When the duty cycle of the PWM dimming signal is relatively small, input current IIN may be reduced to be less than the holding current of triac dimmer TRIAC by regulating a magnitude of input current IIN, or by directly cutting off an input current path for supplying the direct current bus voltage to the LED load.

Figure 5:
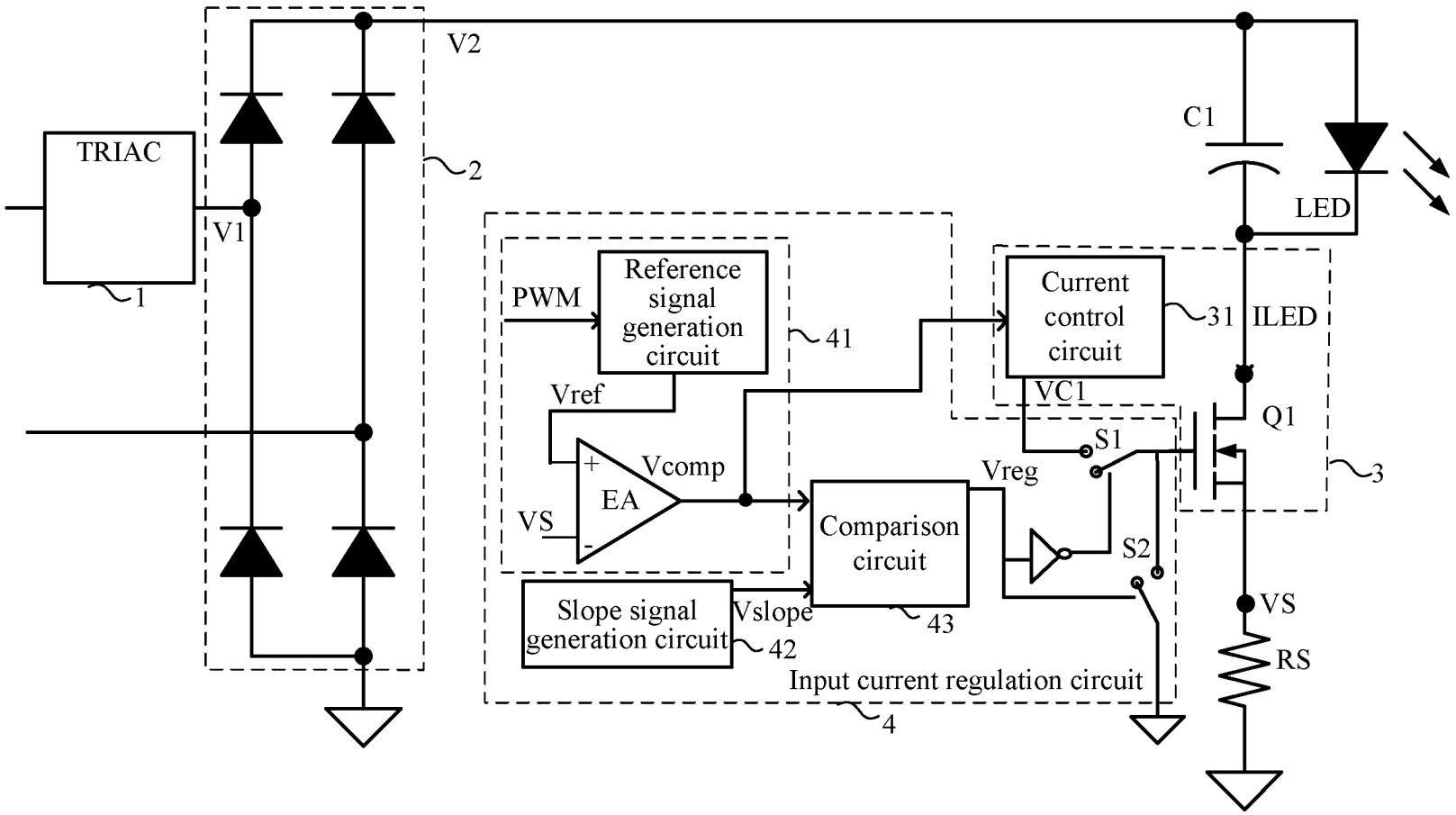
FIG. 5 is a schematic block diagram of a second example current drive circuit, in accordance with embodiments of the present invention.

Referring now to FIG. 5, shown is a schematic block diagram of a second example current drive circuit, in accordance with embodiments of the present invention. In this particular example, an LED lighting device may include triac dimmer TRIAC 1 and rectification circuit 2. A current drive circuit can be applied in the LED lighting device, and may include current generation circuit 3 and input current regulation circuit 4. Triac dimmer TRIAC can connect between an input port of an alternating current voltage and rectification circuit 2. Triac dimmer TRIAC can perform phase-cutting on the alternating current voltage, in order to output voltage signal V1. Rectification circuit 2 can perform conversion on the chopped alternating current voltage of triac dimmer TRIAC; that is, to rectify voltage signal V1, in order to output voltage signal V2, where voltage signal V2 serves as direct current voltage VBUS.

Current generation circuit 3 can receive voltage signal V2, and may generate a drive current ILED based on a PWM dimming signal, in order to drive an LED load. In certain embodiments, current generation circuit 3 can be implemented by a constant current linear drive circuit connected to the LED load. For example, current generation circuit 3 can include current control circuit 31 and transistor Q1. One power terminal of transistor Q1 can connect to a negative terminal of the LED load, the other power terminal of transistor Q1 may be grounded via a current sampling resistor RS, and a control terminal of transistor Q1 can connect to current control circuit 31. An operation state of transistor Q1 may be controlled based on control signal VC1 from current control circuit 31, in order to generate drive current ILED.

When the duty cycle of the PWM dimming signal is less than a reset value, the operation state of transistor Q1 can be controlled based on the duty cycle of the PWM dimming signal to control the magnitude of input current IIN, in order to control the operation state of triac dimmer TRIAC. In one example, current control circuit 31 can regulate a voltage at the gate terminal of transistor Q1 based on the duty cycle of the PWM dimming signal to regulate a current flowing through transistor Q1, in order to reduce an input current of the current drive circuit to be less than a holding current of the triac dimmer. Thus, the triac dimmer may be turned off in advance due to the small input current. Alternatively, transistor Q1 may be controlled to be turned on or turned off based on the duty cycle of the PWM dimming signal to control the input current path to be conductive or cut off, in order to control the operation state of triac dimmer TRIAC.

When current generation circuit 3 is implemented by a switch-type regulator and the duty cycle of the PWM dimming signal is small, a duty cycle of the switch-type regulator can be regulated to reduce the drive current or cut off the input current path, so as to turn off triac dimmer TRIAC. Input current regulation circuit 4 can generate regulation signal Vreg based on the duty cycle of the PWM dimming signal, in order to control the operation state of triac dimmer TRIAC based on the regulation signal Vreg. In this way, when the duty cycle of the PWM dimming signal is small, input current IIN can be reduced to be less than a holding current of triac dimmer TRIAC, and thus triac dimmer TRIAC may not be turned on.

In certain embodiments, when the duty cycle of the PWM dimming signal is small, the input current path can be cut off based on regulation signal Vreg, in order to turn off the triac dimmer. Input current regulation circuit 4 can generate regulation signal Vreg based on a comparison result between a "first" signal for characterizing the duty cycle of the PWM dimming signal and a threshold. When the duty cycle of the PWM dimming signal is small, triac dimmer TRIAC can be turned off based on regulation signal Vreg. It is to be understood that the first signal may be a reference current signal for characterizing the duty cycle of the PWM dimming signal, or a compensation signal generated based on an error between the drive current and a desired drive current corresponding to the PWM dimming signal.

Input current regulation circuit 4 can include compensation signal generation circuit 41, slope signal generation circuit 42, comparison circuit 43, and a switch circuit.

Compensation signal generation circuit 41 can generate compensation signal Vcomp for characterizing the error between the drive current ILED and the desired drive current. In one example, compensation signal generation circuit 41 can include reference signal generation circuit 411, error amplifier EA, and a compensation circuit. Reference signal generation circuit 411 can filter an external PWM dimming signal, and may process the filtered signal based on an internal dimming curve, in order to obtain reference current signal Vref corresponding to the PWM dimming signal. Reference current signal Vref can be positively correlated with the duty cycle of the PWM dimming signal. Error amplifier EA can generate compensation signal Vcomp based on sampling signal VS of the drive current ILED and reference current signal Vref.

For example, reference current signal Vref may be provided to a non-inverting input terminal of error amplifier EA, and sampling signal VS can be provided to an inverting input terminal of the error amplifier EA, such that a negative feedback loop may be formed for drive current ILED, and compensation signal Vcomp can be generated from an output terminal of error amplifier EA. Compensation signal generation circuit 41 can also include a compensation circuit to compensate an output signal of error amplifier EA1, in order to generate compensation signal Vcomp. Further, current control circuit 31 of current generation circuit 3 can generate control signal VC1 based on compensation signal Vcomp to control the operation state of transistor Q1, in order to generate drive current ILED corresponding to the PWM dimming signal.

Since reference current signal Vref is positively correlated with the duty cycle of the PWM dimming signal, and error amplifier EA generates compensation signal Vcomp based on the error between reference current signal Vref and sampling signal VS, a magnitude of compensation signal Vcomp can be capable of characterizing a magnitude of the duty cycle of the PWM dimming signal. Slope signal generation circuit 42 can generate a threshold (e.g., slope signal Vslope). Slope signal Vslope can serve as a reference for determining the magnitude of the duty cycle of the PWM dimming signal. Since the magnitude of compensation signal Vcomp is capable of characterizing the magnitude of the duty cycle of the PWM dimming signal, whether the duty cycle of the PWM dimming signal is small can be determined by determining whether slope signal Vslope rises to compensation signal Vcomp in a cycle. In this way, when the duty cycle of the PWM dimming signal is small, input current IIN can be reduced to be less than a holding current of triac dimmer TRIAC, such that triac dimmer TRIAC is turned off in advance.

Figure 6:
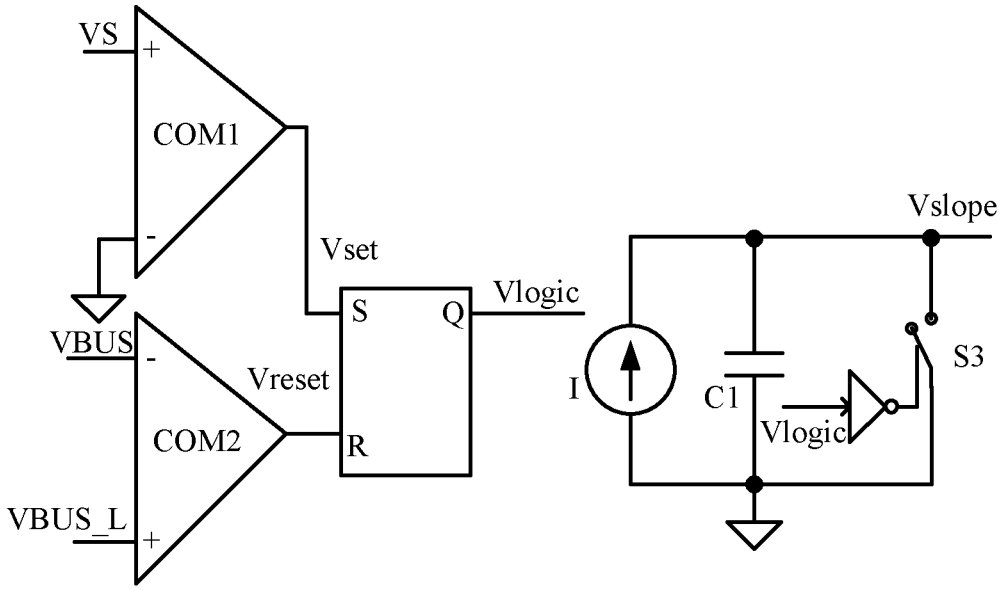
FIG. 6 is a schematic block diagram of an example slope signal generation circuit, in accordance with embodiments of the present invention.

Referring now to FIG. 6, shown is a schematic block diagram of an example slope signal generation circuit, in accordance with embodiments of the present invention. In this particular example, slope signal Vslope generated by slope signal generation circuit 42 can begin rising at a time when the triac dimmer is turned on, and may return to zero when direct current bus voltage VBUS; that is, voltage signal V2 may be less than threshold voltage VBUS_L. In one example, slope signal generation circuit 42 may include comparator COM1, comparator COM2, an RS flip-flop, current source I, capacitor C1, and switch S3. A non-inverting input terminal of comparator COM1 can receive sampling signal VS, and an inverting input terminal of comparator COM1 may be grounded. Comparator COM1 can generate set signal Vset. A non-inverting input terminal of comparator COM2 can receive threshold voltage VBUS_L, and an inverting input terminal of comparator COM2 can receive direct current bus voltage VBUS.

Comparator COM2 can generate reset signal Vreset. Set terminal S of the RS flip-flop can receive set signal Vset, reset terminal R of the RS flip-flop can receive reset signal Vreset, and output terminal Q of the RS flip-flop may generate logic signal Vlogic. Current source I, capacitor C1, and switch S3 can connect in parallel with each other, and switch S3 may be controlled by an inverted version of logic signal Vlogic. When switch S3 is turned off, current source I can charge capacitor C1, and the increased slope signal Vslope may be generated on capacitor C1. When switch S3 is turned on, slope signal Vslope on capacitor C1 can return to zero. Comparison circuit 43 can generate regulation signal Vreg based on compensation signal Vcomp and slope signal Vslope.

Figure 7:
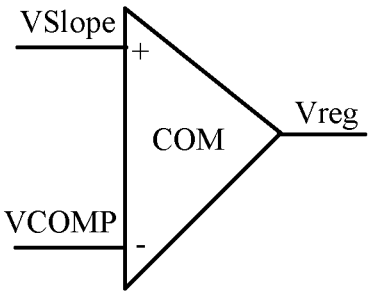
FIG. 7 is a schematic block diagram of an example comparison circuit, in accordance with embodiments of the present invention.

Referring now to FIG. 7, shown is a schematic block diagram of an example comparison circuit, in accordance with embodiments of the present invention. In this particular example, comparison circuit 43 can include comparator COM3. An inverting input terminal of comparator COM3 can receive compensation signal Vcomp, and a non-inverting input terminal of comparator COM3 can receive slope signal Vslope. Comparator COM3 can generate regulation signal Vreg. When slope signal Vslope is greater than compensation signal Vcomp, the input current path may be cut off based on regulation signal Vreg. In other examples, regulation signal Vreg may be generated based on reference current signal Vref for characterizing the duty cycle of the PWM dimming signal and a threshold. In particular embodiments, compensation signal Vcomp may be provided to both current control circuit 31 and comparison circuit 43. Current control circuit 31 can control, based on compensation signal Vcomp, transistor Q1, in order to control the magnitude of drive current ILED. Comparison circuit 43 can control, based on compensation signal Vcomp, a time when transistor Q1 is turned off actively in advance, in order to cut off the input current path when the duty cycle of the PWM dimming signal is small.

Referring back to FIG. 5, input current regulation circuit 4 also can include a switch circuit. The input current path can be controlled to be conductive or cut off by controlling transistor Q1 to be turned on or turned off based on regulation signal Vreg. In certain embodiments, the switch circuit can include switches S1 and S2 that are controlled based on regulation signal Vreg. When regulation signal Vreg is inactive, switch S1 can be turned on, in order to couple a control terminal of transistor Q1 to current control circuit 31. When regulation signal Vreg is active, switch S2 can instead be turned on, in order to ground the control terminal of transistor Q1, such that transistor Q1 is turned off, thereby cutting off the input current path, and thus turning off triac dimmer TRIAC. When transistor Q1 is turned off, the input current path may be cut off. In this case, since input current IIN is less than the holding current of triac dimmer TRIAC, triac dimmer TRIAC can be turned off. Since direct current bus voltage VBUS may rise due to a filtering capacitor in triac dimmer TRIAC, while triac dimmer TRIAC does not operate in an integration phase, triac dimmer TRIAC may not be restarted due to an insufficient holding current or the integration. In this way, LED load flickering in a dimming process due to a relatively small duty cycle of the PWM dimming signal can be substantially avoided.

Figure 8:
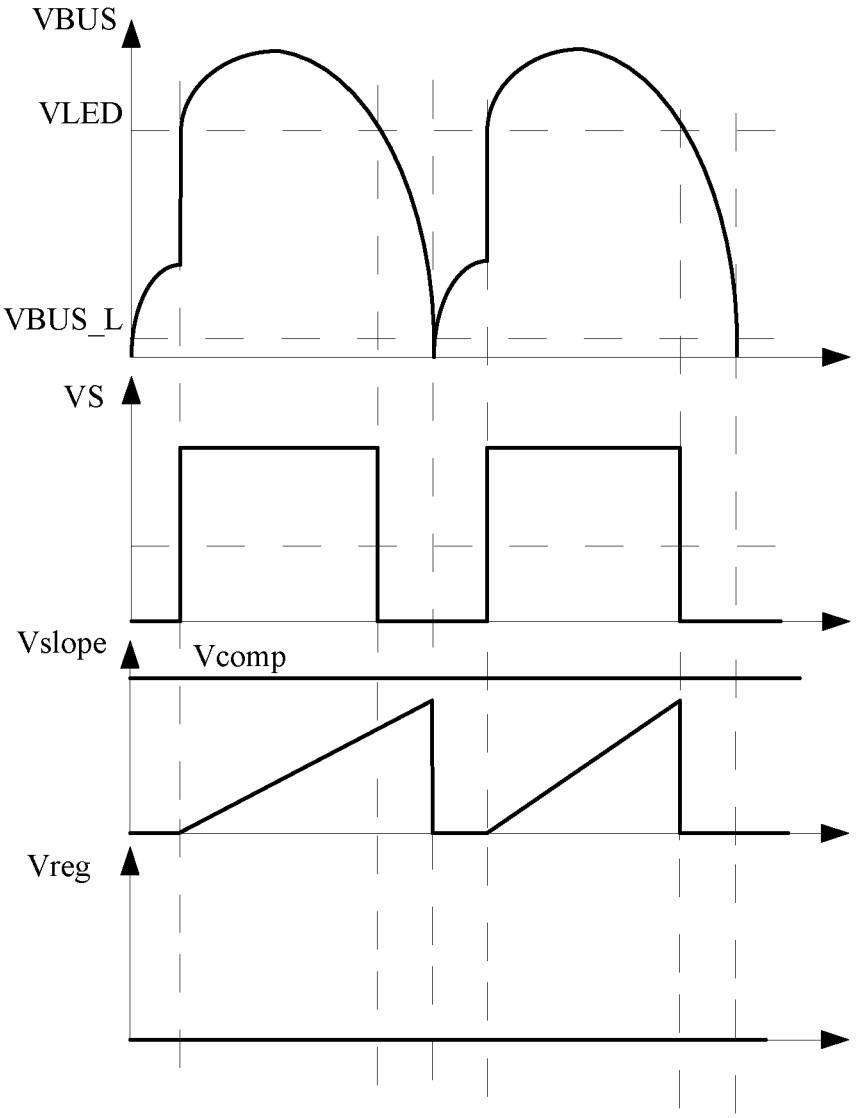
FIG. 8 is a waveform diagram of example operation of a current drive circuit, in accordance with embodiments of the present invention.
Figure 9:
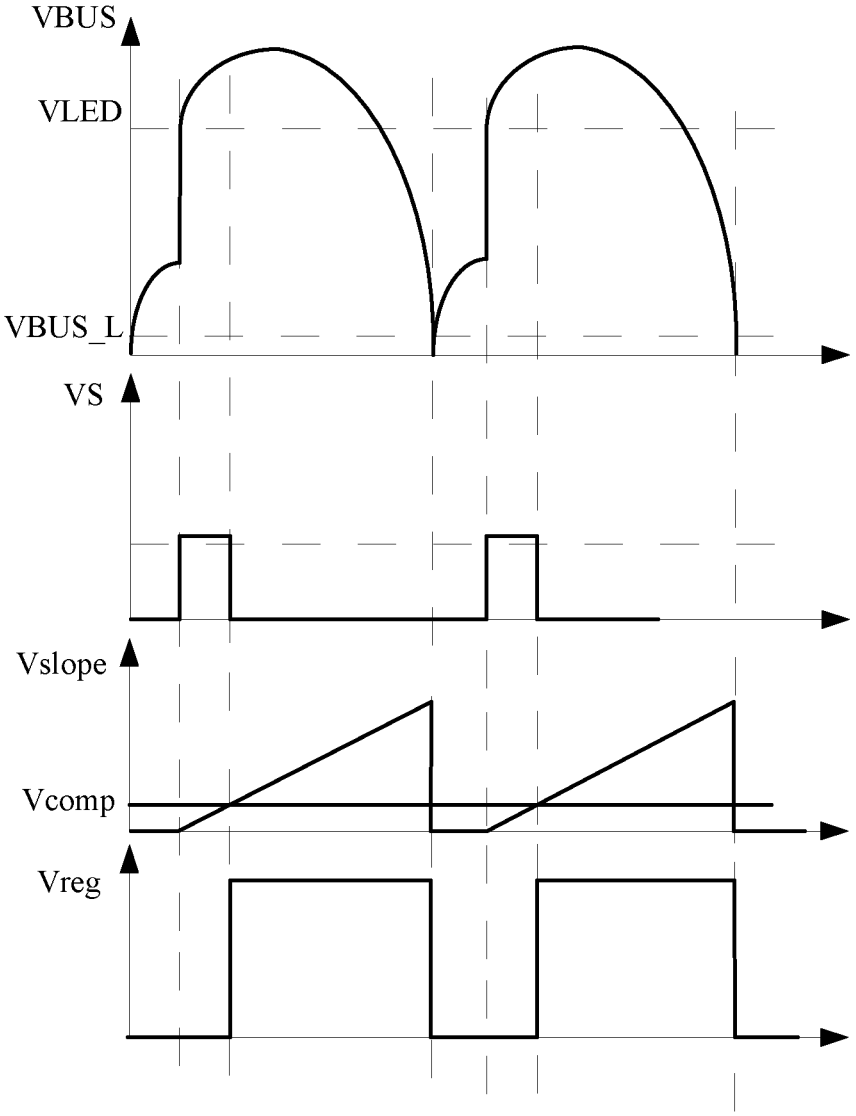
FIG. 9 is a waveform diagram of another example operation of a current drive circuit, in accordance with embodiments of the present invention.

Referring now to FIG. 8, shown is a waveform diagram of example operation of a current drive circuit, in accordance with embodiments of the present invention. Referring also to FIG. 9, shown is a waveform diagram of another example operation of a current drive circuit, in accordance with embodiments of the present invention. FIG. 8 shows an operation waveform of a current drive circuit when the duty cycle of the PWM dimming signal is relatively large, while FIG. 9 shows an operation waveform of a current drive circuit when the duty cycle of the PWM dimming signal is relatively small. As can be seen from FIGS. 8 and 9, when the duty cycle of the PWM dimming signal is relatively large, comparison circuit 43 can compare compensation signal Vcomp against slope signal Vslope. Since compensation signal Vcomp is larger, slope signal Vslope may not rise to be as large as compensation signal Vcomp, or a case that slope signal Vslope is greater than compensation signal Vcomp occurs after a time period in which direct current bus voltage VBUS is less than drive voltage VLED of the LED load.

In this case, transistor Q1 may not be turned off actively and can be controlled by current control circuit 31, such that sampling signal VS falls to zero when direct current bus voltage VBUS is equal to drive voltage VLED of the LED load. When the duty cycle of the PWM dimming signal is small, the case that slope signal Vslope is greater than compensation signal Vcomp can occur in a time period in which direct current bus voltage VBUS is greater than drive voltage VLED of the LED load. In this case, transistor Q1 can be controlled to be turned off actively, and the input current path may be cut off, such that triac dimmer TRIAC is turned off in advance while not being restarted. In certain embodiments, the current drive circuit can be compatible with the triac dimmer in an intelligent dimming process. When the duty cycle of the PWM dimming signal is relatively small, the input current path can be cut off actively, such that the triac dimmer is turned off in advance while not being restarted. This can substantially avoid LED load flickering that can occur in a dimming process due to a small duty cycle of the PWM dimming signal.

Figure 10:
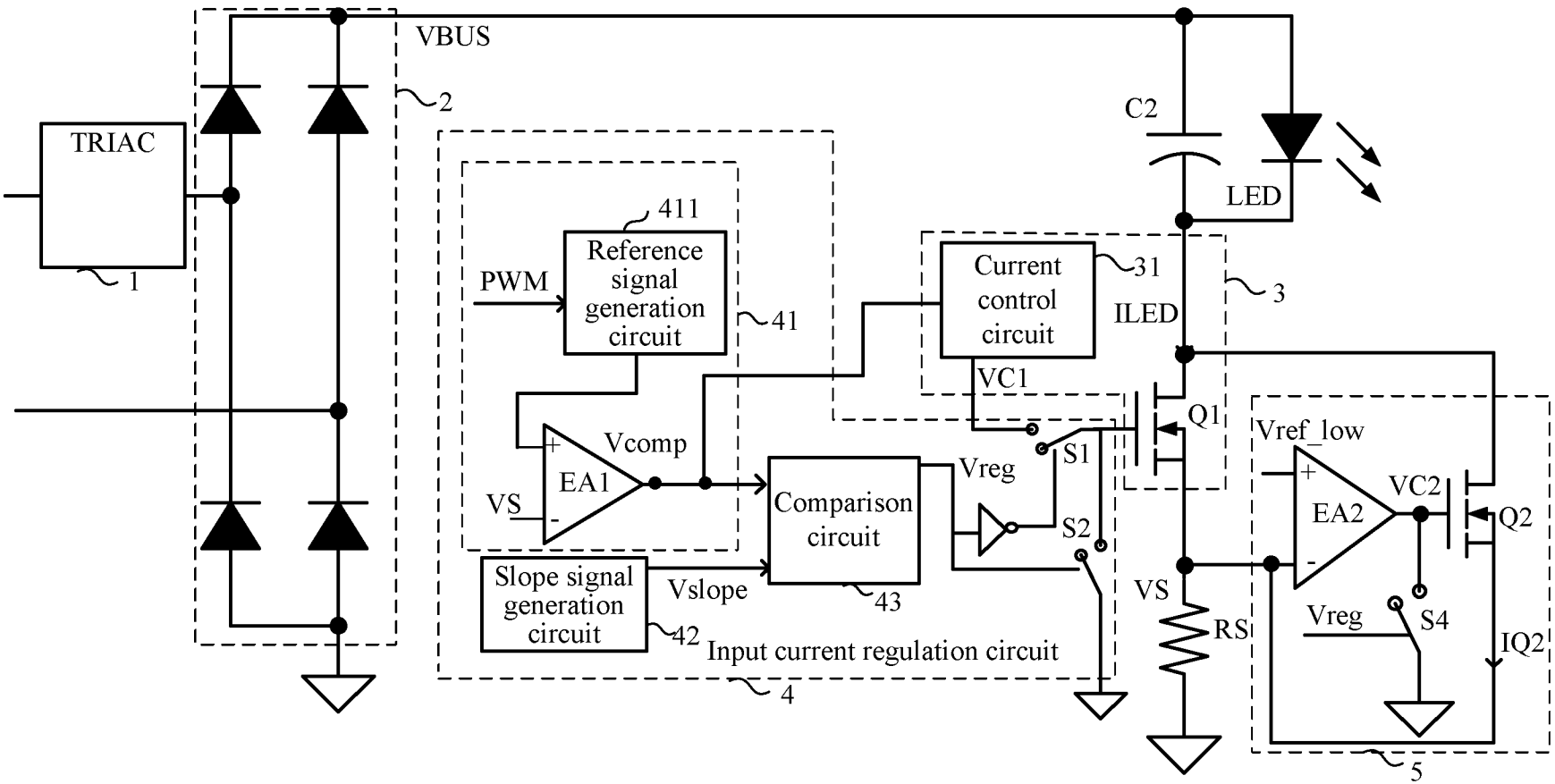
FIG. 10 is a schematic block diagram of a third example current drive circuit, in accordance with embodiments of the present invention.
Figure 11:
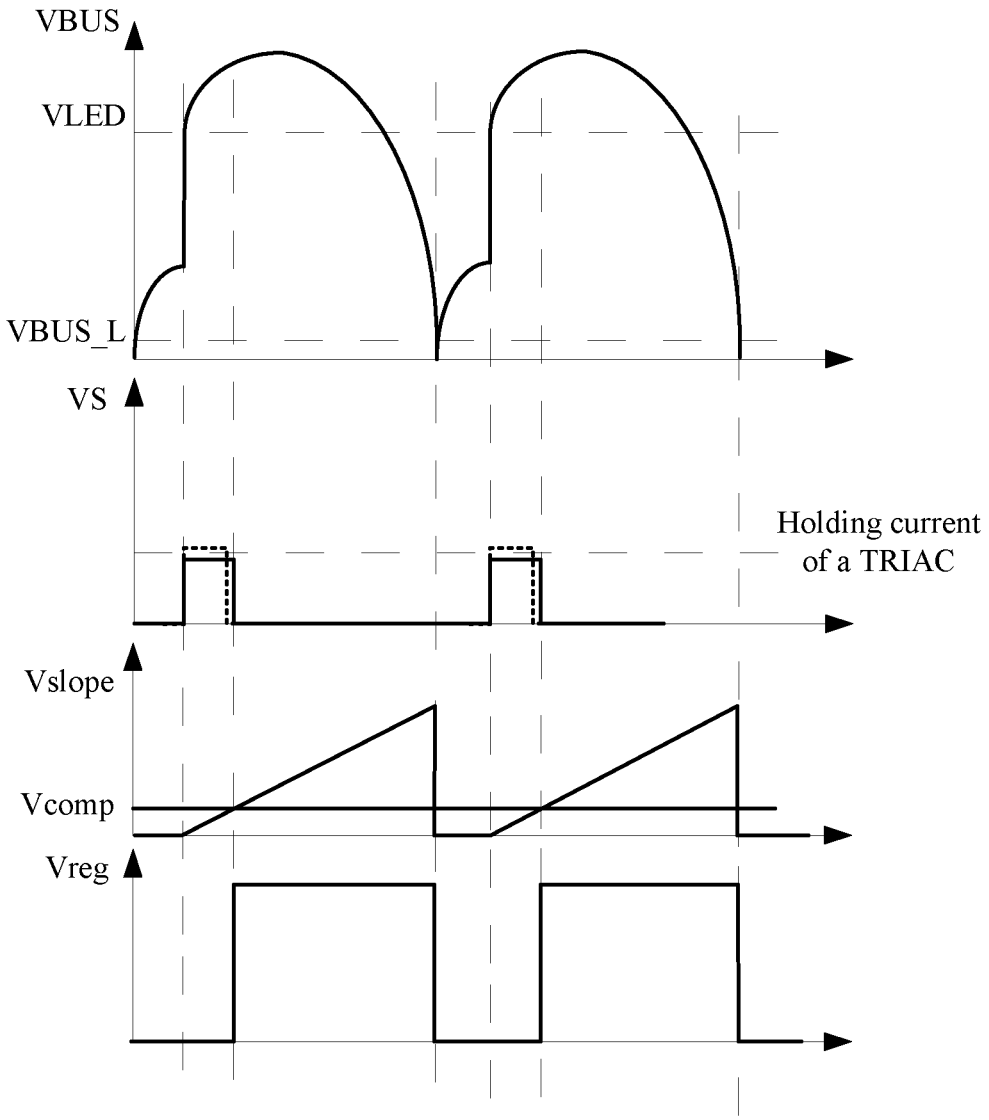
FIG. 11 is a waveform diagram of another example operation of a current drive circuit, in accordance with embodiments of the present invention.

Referring now to FIG. 10, shown is a schematic block diagram of a third example current drive circuit, in accordance with embodiments of the present invention. In this particular example, current compensation circuit 5 can be included. Referring also to FIG. 11, shown is a waveform diagram of another example operation of a current drive circuit, in accordance with embodiments of the present invention. In this particular example, the waveform of sampling signal VS with a solid line can represent operation waveforms of the current drive circuit without the current compensation circuit, and the waveform of sampling signal VS with dotted line can represent operation waveforms of the current drive circuit with the current compensation circuit.

Current compensation circuit 5 can generate compensation current IQ2 when the duty cycle of the PWM dimming signal is relatively small and the input current path is conductive, in order to maintain the triac dimmer in a turned-on state at the start of the conduction of the triac dimmer. In this example, when the duty cycle of the PWM dimming signal is small, at the start of the conduction of the triac dimmer, input current IIN greater than the holding current can hardly be supplied to the triac dimmer TRIAC. In this case, triac dimmer TRIAC can turn off and become unstable. To deal with this problem, current compensation circuit 5 can additionally supply compensation current IQ2 to triac dimmer TRIAC, such that input current IIN may be increased in order to maintain the triac dimmer in an ON state. For example, current compensation circuit 5 can connect to transistor Q1 in parallel, and can include transistor Q2, error amplifier EA2, and switch S4. Transistor Q2 can connect to transistor Q1 in parallel; that is, power terminals of transistors Q1 and Q2 may be connected to each other. Switch S4 can be controlled to be turned on/off based on regulation signal Vreg. When switch S4 is turned on, since a control terminal of transistor Q2 can be grounded, transistor Q2 may be turned off.

Error amplifier EA2 can generate control signal VC2 based on sampling signal VS of drive current ILED and reference signal Vref low for characterizing an excessive low input current, to control transistor Q2 to be turned on, in order to generate the compensation current IQ2 to compensate input current IIN when the input current path is conductive. In this way, the problem of triac dimmer TRIAC being turned off due to an insufficient holding current when the duty cycle of the PWM dimming signal is small can be substantially avoided. Further, when regulation signal Vreg is active, the input current path can be controlled to be cut off by simultaneously turning off transistor Q1 and current compensation circuit 5 based on regulation signal Vreg.

Further, as compared with the waveform of VS with the solid line, since current IQ2 is supplied to triac dimmer TRIAC, input current IIN can be increased at the start of the conduction of the triac dimmer. Since drive current ILED equals input current IIN, sampling signal VS of drive current ILED can be increased, and the triac dimmer may be maintained in the on state. When slope signal Vslope is increased to compensation signal Vcomp, regulation signal Vreg is active, the input current path can be controlled to be cut off by simultaneously turning off transistors Q1 and Q2 based on regulation signal Vreg, and sampling signal VS can fall to zero. With the current drive circuit in certain embodiments, input current IIN can be compensated when the duty cycle of the PWM dimming signal is small and the input current path is conductive, thereby substantially avoiding the problem of the triac dimmer TRIAC being turned off due to insufficient holding current when the duty cycle of the PWM dimming signal is small.

Figure 12:
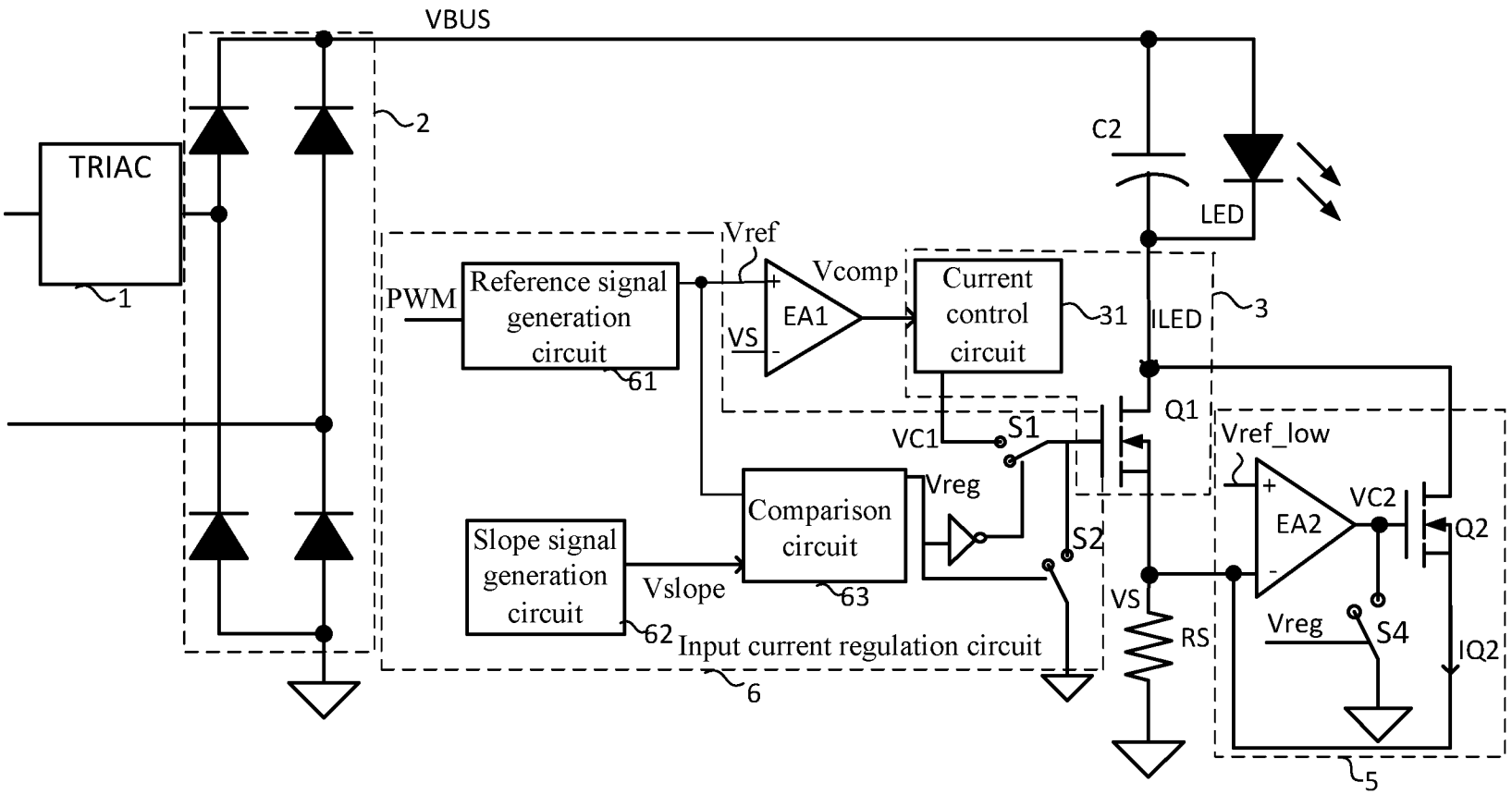
FIG. 12 is a schematic block diagram of a fourth example current drive circuit, in accordance with embodiments of the present invention.

Referring now to FIG. 12, shown is a schematic block diagram of a fourth example current drive circuit, in accordance with embodiments of the present invention. In this particular example, input current regulation circuit 6 can generate regulation signal Vreg based on a comparison result between a "first" signal for characterizing the duty cycle of the PWM dimming signal and a threshold. When the duty cycle of the PWM dimming signal is less than a preset value, the operation state of triac dimmer TRIAC can be controlled based on regulation signal Vreg. For example, when the duty cycle of the PWM dimming signal is less than a preset value, transistor Q1 may be turned off to control the input current path to be cut off, in order to control triac dimmer TRIAC to be turned off. In this example, the first signal may be a reference current signal for characterizing the duty cycle of the PWM dimming signal.

In one example, the input current regulation circuit 6 can include reference signal generation circuit 61, slope signal generation circuit 62, and comparison circuit 63. Reference signal generation circuit 61 can filter an external PWM dimming signal, and may process the filtered signal based on an internal dimming curve, in order to obtain reference current signal Vref corresponding to the PWM dimming signal. Reference current signal Vref can be positively correlated with the duty cycle of the PWM dimming signal. Slope signal generation circuit 62 can generate the threshold (e.g., slope signal Vslope). Slope signal Vslope can serve as a reference for determining the magnitude of the duty cycle of the PWM dimming signal. Since the magnitude of compensation signal Vcomp is capable of characterizing the magnitude of the duty cycle of the PWM dimming signal, whether the duty cycle of the PWM dimming signal is small can be determined by determining whether slope signal Vslope rises to compensation signal Vcomp in a cycle.

Comparison circuit 63 can include comparator COM3. An inverting input terminal of comparator COM3 can receive reference current signal Vref, and a non-inverting input terminal of comparator COM3 can receive slope signal Vslope. Comparator COM3 can generate regulation signal Vreg by comparing reference current signal Vref against slope signal Vslope. For example, when slope signal Vslope is greater than reference current signal Vref, the input current of the current drive circuit can be reduced to be less than a holding current of the triac dimmer, in order to turn off the triac dimmer in advance.

Input current regulation circuit 6 can also include switch circuit 64 coupled to control terminal of transistor Q1, and may switch a voltage at the control terminal of transistor Q1 between a ground and control signal VC1 based on regulation signal Vreg. In one example, when slope signal Vslope is greater than reference current signal Vref, regulation signal Vreg can be active, and the control terminal of transistor Q1 may be grounded. Thus, the input current path for supplying the direct current bus voltage to the LED load can be cut off, in order to turn off the triac dimmer in advance. When slope signal Vslope is not greater than reference current signal Vref, regulation signal Vreg may be inactive, and the control terminal of transistor Q1 can receive control signal VC1 generated by current control circuit 31.

Thus, the current flowing through transistor Q1 can be controlled based on compensation signal Vcomp representative of an error between reference current signal Vref corresponding to PWM dimming signal and sampling signal VS of drive current ILED, in order to control drive current ILED. In this way, when the duty cycle of the PWM dimming signal is small, the operation state of triac dimmer TRIAC can be controlled, thereby avoiding the potential LED flickering problem due to a small duty cycle of the PWM dimming signal.

The embodiments were chosen and described in order to best explain the principles of the invention and its practical applications, to thereby enable others skilled in the art to best utilize the invention and various embodiments with modifications as are suited to particular use(s) contemplated. It is intended that the scope of the invention be defined by the claims appended hereto and their equivalents.

What is claimed is:

1. A current drive circuit applied in a light-emitting diode (LED) drive circuit, wherein the LED drive circuit is compatible with a triac dimmer and is configured to generate a direct current bus voltage, the current drive circuit comprising:

a) a current generation circuit configured to receive the direct current bus voltage, and to generate a drive current based on a pulse-width modulation (PWM) dimming signal, in order to drive an LED load; and b) an input current regulation circuit configured to generate a regulation signal based on a duty cycle of the PWM dimming signal, in order to control an operation state of the triac dimmer.

2. The current drive circuit of claim 1, wherein when the duty cycle of the PWM dimming signal is less than a preset value, an input current of the current drive circuit is reduced to be less than a holding current of the triac dimmer, in order to turn off the triac dimmer.

3. The current drive circuit of claim 1, wherein when the duty cycle of the PWM dimming signal is less than a preset value, an input current path for supplying the direct current bus voltage to the LED load is cut off based on the regulation signal, in order to turn off the triac dimmer.

4. The current drive circuit of claim 1, wherein:

a) the input current regulation circuit is configured to generate the regulation signal based on a comparison result between a first signal for characterizing the duty cycle of the PWM dimming signal and a threshold; and b) when the duty cycle of the PWM dimming signal is less than a preset value, the triac dimmer is turned off based on the regulation signal.

5. The current drive circuit of claim 4, wherein the first signal is a reference current signal for characterizing the duty cycle of the PWM dimming signal.

6. The current drive circuit of claim 4, wherein the first signal is a compensation signal generated based on an error between the drive current and a desired drive current corresponding to the PWM dimming signal.

7. The current drive circuit of claim 4, wherein the threshold is indicated by a slope signal that starts rising at a time when the triac dimmer is turned on and returns to zero when the direct current bus voltage is less than a threshold voltage.

8. The current drive circuit of claim 1, wherein when the duty cycle of the PWM dimming signal is less than a preset value, the drive current is reduced to reduce an input current of the current drive circuit, in order to turn off the triac dimmer.

9. The current drive circuit of claim 1, wherein:

a) the current generation circuit comprises a constant current linear drive circuit coupled to the LED load;

b) the current generation circuit comprises a first transistor coupled in series to the LED load; and c) an operation state of the first transistor is controlled based on the regulation signal, in order to regulate an input current of the current drive circuit to control the operation state of the triac dimmer.

10. The current drive circuit of claim 9, wherein the first transistor is controlled to be turned on or turned off based on the regulation signal, in order to conduct or cut off an input current path for supplying the direct current bus voltage to the LED load.

11. The current drive circuit of claim 10, wherein:

a) the input current regulation circuit comprises a switch circuit coupled to a control terminal of the first transistor, and wherein the input current regulation is configured to switch a voltage at the control terminal of the first transistor between a ground and a control signal based on the regulation signal; and b) the control signal is generated based on a compensation signal representative of an error between the drive current and a desired drive current corresponding to the PWM dimming signal.

12. The current drive circuit of claim 1, further comprising a current compensation circuit configured to generate a compensation current at the start of the conduction of the triac dimmer when the duty cycle of the PWM dimming signal is small and an input current path conducts, in order to maintain the triac dimmer in a turned-on state.

13. The current drive circuit of claim 12, wherein:

a) the current compensation circuit is connected in parallel to a first transistor that is connected in series to the LED load; and b) the input current path is controlled to be cut off by simultaneously turning off the first transistor and the current compensation circuit based on the regulation signal.

14. The current drive circuit of claim 1, wherein:

a) the current generation circuit comprises a switch-type regulator to generate the drive current based on the PWM dimming signal; and b) when the duty cycle of the PWM dimming signal is less than a preset value, a duty cycle of the switch-type regulator is regulated based on the regulation signal to reduce the drive current, in order to turn off the triac dimmer.

15. The current drive circuit of claim 1, wherein:

a) the current generation circuit comprises a switch-type regulator to generate the drive current based on the PWM dimming signal; and b) when the duty cycle of the PWM dimming signal is less than a preset value, an input current path for supplying the direct current bus voltage to the LED load is cut off based on the regulation signal.

16. A current drive method applied in a light-emitting diode (LED) drive device compatible with a triac dimmer and generating a direct current bus voltage, the method comprising:

a) receiving the direct current bus voltage, and generating a drive current based on a pulse-width modulation (PWM) dimming signal, in order to drive an LED load; and b) generating a regulation signal based on a duty cycle of the PWM dimming signal, in order to control an operation state of the triac dimmer.

17. The method of claim 16, further comprising reducing an input current of the current drive circuit to be less than a holding current of the triac dimmer when the duty cycle of the PWM dimming signal is less than a preset value, in order to turn off the triac dimmer.

18. The method of claim 17, further comprising cutting off an input current path for supplying the direct current bus voltage to the LED load based on the regulation signal when the duty cycle of the PWM dimming signal is less than a preset value, in order to turn off the triac dimmer.

19. The method of claim 17, further comprising:

a) generating the regulation signal based on a comparison result between a first signal for characterizing the duty cycle of the PWM dimming signal and a threshold; and b) turning off the triac dimmer based on the regulation signal when the duty cycle of the PWM dimming signal is less than a preset value.

20. The method of claim 19, wherein the threshold comprises a slope signal that starts rising at a time when the triac dimmer is turned on and returns to zero when the direct current bus voltage is less than a threshold voltage.

* * * * *